US008167411B2

(12) United States Patent
Takeuchi et al.

(10) Patent No.: US 8,167,411 B2
(45) **Date of Patent: *May 1, 2012**

(54) PRINT ELEMENT SUBSTRATE, INKJET PRINTHEAD, AND PRINTING APPARATUS

(75) Inventors: Souta Takeuchi, Yokohama (JP); Yoshiyuki Imanaka, Kawasaki (JP); Koichi Omata, Kawasaki (JP); Takaaki Yamaguchi, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 404 days.

This patent is subject to a terminal disclaimer.

(21) Appl. No.: 12/428,985

(22) Filed: Apr. 23, 2009

(65) Prior Publication Data

US 2009/0278879 A1 Nov. 12, 2009

(30) Foreign Application Priority Data

May 8, 2008 (JP) ..... 2008-122773

(51) Int. Cl.
*B41J 2/05* (2006.01)

(52) U.S. Cl. ..... 347/57; 347/13; 347/40; 347/62

(58) Field of Classification Search ..... 347/40, 347/12–13, 56–59, 62, 65
See application file for complete search history.

(56) References Cited

U.S. PATENT DOCUMENTS

| | | | |
|---|---|---|---|
| 5,754,193 | A | 5/1998 | Elhatem |
| 5,754,201 | A | 5/1998 | Ishinaga et al. |
| 6,137,502 | A | 10/2000 | Anderson et al. |
| 6,293,655 | B1 | 9/2001 | Imanaka et al. |
| 6,409,315 | B2 | 6/2002 | Komuro |
| 6,431,685 | B1 | 8/2002 | Misumi |
| 6,474,790 | B2 | 11/2002 | Kaneko |
| 6,966,629 | B2 | 11/2005 | Nakajima et al. |
| 7,309,120 | B2 | 12/2007 | Hatsui et al. |
| 7,819,493 | B2 | 10/2010 | Hirayama et al. |
| 2002/0089565 | A1 | 7/2002 | Lopez et al. |
| 2002/0118241 | A1 | 8/2002 | Fujii |
| 2006/0238558 | A1 | 10/2006 | Hatasa et al. |
| 2007/0091131 | A1 | 4/2007 | Hatsui et al. |
| 2007/0165055 | A1 | 7/2007 | Hirayama et al. |
| 2007/0296745 | A1 | 12/2007 | Kasai et al. |
| 2008/0100649 | A1 | 5/2008 | Matsui et al. |
| 2008/0111864 | A1 | 5/2008 | Yamaguchi et al. |
| 2009/0278890 | A1* | 11/2009 | Yamaguchi et al. ..... 347/40 |
| 2011/0012950 | A1 | 1/2011 | Hirayama et al. |

FOREIGN PATENT DOCUMENTS

| | | | |
|---|---|---|---|
| CN | 1163828 | A | 11/1997 |
| EP | 1543972 | A1 | 6/2005 |
| JP | 2002-374163 | A | 12/2002 |
| TW | I249472 | B | 2/2006 |
| TW | I253402 | B | 4/2006 |

* cited by examiner

*Primary Examiner* — Jason Uhlenhake
(74) *Attorney, Agent, or Firm* — Fitzpatrick, Cella, Harper & Scinto

(57) ABSTRACT

This invention is directed to an element substrate including a plurality of print element arrays in which print elements are arranged at different arrayed densities. The element substrate can efficiently transfer data to each print element. The element substrate includes the following arrangement. More specifically, the first print element array having a relatively large number of print elements, and the second print element array which is equal in length to the first print element array and has a relatively small number of print elements are juxtaposed. The element substrate includes one shift register which holds data for driving the print element of the second print element array, and a plurality of shift registers for dividing and holding data for driving the print elements of the first print element array.

7 Claims, 15 Drawing Sheets

PRINT ELEMENT SUBSTRATE, INKJET PRINTHEAD, AND PRINTING APPARATUS

BACKGROUND OF THE INVENTION

1. Field of the Invention

The present invention relates to a print element substrate including a plurality of print element arrays in which different numbers of print elements are arrayed, an inkjet printhead, and a printing apparatus.

2. Description of the Related Art

A printhead which prints on a printing medium by discharging ink according to a thermal inkjet method includes, as print element building elements in the printhead, heaters formed from heat generation elements. Drivers for driving heaters, and logic circuits for selectively driving the drivers in accordance with print data are formed on a single element substrate of the printhead.

The resolution of thermal inkjet type color inkjet printing apparatuses is increasing year by year. Along with this, the orifice arrangement density of a printhead is set to discharge ink in the range of a resolution of 600 dpi to resolutions of 900 dpi and 1,200 dpi. There is known a printhead having orifices at such high density.

Demand has arisen for reducing graininess at a halftone portion or highlight portion in a gray image and color photo image. To meet this demand, the size of an ink droplet (liquid droplet) discharged to form an image was about 15 pl several years ago, but is recently decreasing to 5 pl and then 2 pl year after year in a printhead which discharges color ink.

A high-resolution printhead in which orifices for discharging small ink droplets are arranged at high density satisfies a user need for high-quality printing when printing a high-quality color graphic image or photo image. However, when not high-resolution printing but high-speed printing is required in, for example, printing a color graph in a spreadsheet, the above-mentioned printhead may not meet the demand for high-speed printing because printing with small ink droplets increases the number of print scan operations.

To achieve even high-speed printing, there has been proposed a printhead which discharges small ink droplets for high-quality printing and large ink droplets for high-speed printing. There have also been known a printhead in which a plurality of heaters are arranged for one orifice to change the discharge amount by these heaters, and a printhead in which a plurality of orifices having different discharge amounts are arranged in one element substrate.

Element substrates having a plurality of orifices for discharging different amounts of ink include an element substrate in which an orifice array (small-droplet orifice array) of orifices for discharging small ink droplets, and an orifice array (large-droplet orifice array) of orifices for discharging large ink droplets are juxtaposed. To achieve high-quality printing at high speed by this element substrate, there is proposed an element substrate in which the orifice arrangement density of a small-droplet orifice array is higher than that of a large-droplet orifice array. An example of this element substrate is one having a large-droplet orifice array in which 600 orifices are arranged per inch (arrangement density is 600 dpi), and a small-droplet orifice array in which 1,200 orifices double in number are arranged per inch (arrangement density is 1,200 dpi).

To stably discharge ink, a stable voltage needs to be applied to heaters. When all heaters are driven concurrently, a large current flows, and the voltage greatly drops owing to the wiring resistance. To solve this, there is a time-divisional driving method of dividing a plurality of heaters on an element substrate into a plurality of blocks, and sequentially driving heaters for the respective blocks time-divisionally to stably discharge ink. Examples of this element substrate are arrangements disclosed in the U.S. Pat. Nos. 6,409,315, 6,474,790, 5,754,201, 6,137,502, and 6,966,629, and Japanese Patent Laid-Open No. 2002-374163.

Recent inkjet printing apparatuses discharge small ink droplets to print a high-quality image. At the same time, these inkjet printing apparatuses need to increase the print speed. Simply forming the same image requires the same ink amount. Thus, if the discharged ink droplet is downsized to decrease the discharged ink amount to ½, the print speed simply decreases to ½.

To discharge the same ink amount in the same time in order to prevent a decrease in print speed, the number of heaters needs to be doubled. If the number of heaters is doubled without changing the heater arrangement density, the size of an element substrate in which heaters are arranged increases double or more. In addition to the increase in element substrate size, this also increases the size of the printhead which moves at high speed in the printing apparatus, the size of the printing apparatus, and vibrations and noise. To prevent these, the heater arrangement density needs to be increased.

To print at high speed, a printhead having orifices for discharging large ink droplets is more advantageous than one having only orifices for discharging small ink droplets. Recent inkjet printing apparatuses adopt a printhead having an element substrate in which a small-droplet orifice array and large-droplet orifice array are juxtaposed. These inkjet printing apparatuses achieve both high-speed printing and high-quality printing by selectively driving orifices for discharging small ink droplets and those for discharging large ink droplets. However, to implement both high-speed printing and high-quality printing, the numbers of orifices and heaters integrated on the element substrate need to be increased.

An element substrate in which the orifice arrangement density of a small-droplet orifice array is higher than that of a large-droplet orifice array will be described. As this element substrate, an element substrate including a large-droplet orifice array at an arrangement density of 600 dpi and a small-droplet orifice array with a double number of orifices at a double arrangement density of 1,200 dpi, which are arranged on a single substrate, will be exemplified. In this element substrate, when printing one pixel by one bit, the number of heaters directly equals the number of bits of print data. The data amount necessary for the orifice array at the arrangement density of 1,200 dpi is double the data amount necessary for the orifice array at the arrangement density of 600 dpi.

As an example of the time-divisional driving method, the time-divisional counts of respective orifice arrays on an element substrate are sometimes set equal to each other. Since a common clock is used within the element substrate, the clock frequency is the same. For this reason, the data transfer speed is proportional to the number of bits in a shift register used to transfer data. Data is transferred for each orifice array, so the time taken for data transfer differs between a high-density orifice array and a low-density orifice array. For example, assume that the number of bits in a shift register corresponding to an orifice array made up of a relatively small number of orifices is 6 bits (4 bits for print data and 2 bits for block control data). Also assume that the number of bits in a shift register corresponding to an orifice array made up of a relatively lager number of orifices is 10 bits (8 bits for print data and 2 bits for block control data). In this case, even the data transfer speed for the 6-bit shift register is limited by that for the 10-bit shift register. Therefore, the 6-bit shift register transfers data at 6/10 of the original data transfer speed.

There is also a method of increasing the frequency of a clock for transferring print data in order to print at high speed. In general, the clock is supplied from the printing apparatus main body to the printhead. The printhead which moves during printing, and the printing apparatus main body are connected by a relatively long cable such as a flexible cable. Since this cable contains plural signal lines and current supply lines, noise is readily superposed on signals transmitted through the cable. The inductance component of the cable delays the rise and fall of the pulse waveform (distorted waveform). This becomes non-negligible because, as the clock cycle shortens, the ratio of fluctuations becomes relatively high. Thus, the printhead may malfunction. When a signal is transmitted using a high-frequency clock, the cable may function as an antenna to generate radiation noise. The radiation noise may cause the malfunction of a peripheral device.

SUMMARY OF THE INVENTION

Accordingly, the present invention is conceived as a response to the above-described disadvantages of the conventional art.

For example, a print element substrate including a plurality of print element arrays in which print elements are arranged at different arrayed densities according to this invention is capable of suppressing a decrease in the driving speed of a high-density print element array and efficiently transferring data to each print element.

According to one aspect of the present invention, preferably, there is provided a print element substrate comprising: a first print element array having a plurality of print elements; a second print element array having a plurality of print elements; a first driving circuit which divides the plurality of print elements included in the first print element array into a predetermined number of groups and time-divisionally drives print elements belonging to each group; a second driving circuit which divides the plurality of print elements included in the second print element array into a number of groups larger than the predetermined number of groups, and time-divisionally drives print elements belonging to each group; a first shift register circuit which holds data for driving the print elements belonging to the first print element array; a second shift register circuit and a third shift register circuit which divide a plurality of groups forming the second print element array into at least a first group set and a second group set, and hold data for driving the print elements belonging to each group set; and a signal line which transfers an externally input signal to each of the first shift register circuit, the second shift register circuit, and the third shift register circuit.

According to another aspect of the present invention, preferably, there is provided an inkjet printhead, having the above print element substrate, for printing by discharging ink.

According to still another aspect of the present invention, preferably, there is provided a printing apparatus having a carriage to which the above inkjet printhead can be attached.

The invention is particularly advantageous since data can be transferred to each print element efficiently in an element substrate including a plurality of print element arrays in which print elements are arranged at different arrayed densities.

Further features of the present invention will become apparent from the following description of exemplary embodiments with reference to the attached drawings.

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, an element substrate (substrate for a printhead) in the description not only includes a simple substrate made of a silicon semiconductor, but also broadly includes an arrangement having elements, wires, and the like.

The expression "on a substrate" not only includes "on an element substrate", but also broadly includes "on the surface of an element substrate" and "inside of an element substrate near its surface". The term "built-in" in the invention not only includes "simply arrange separate elements on a substrate", but also broadly includes "integrally form and manufacture elements on an element substrate by a semiconductor circuit manufacturing process or the like".

<Inkjet Printing Apparatus>

Figure 12:
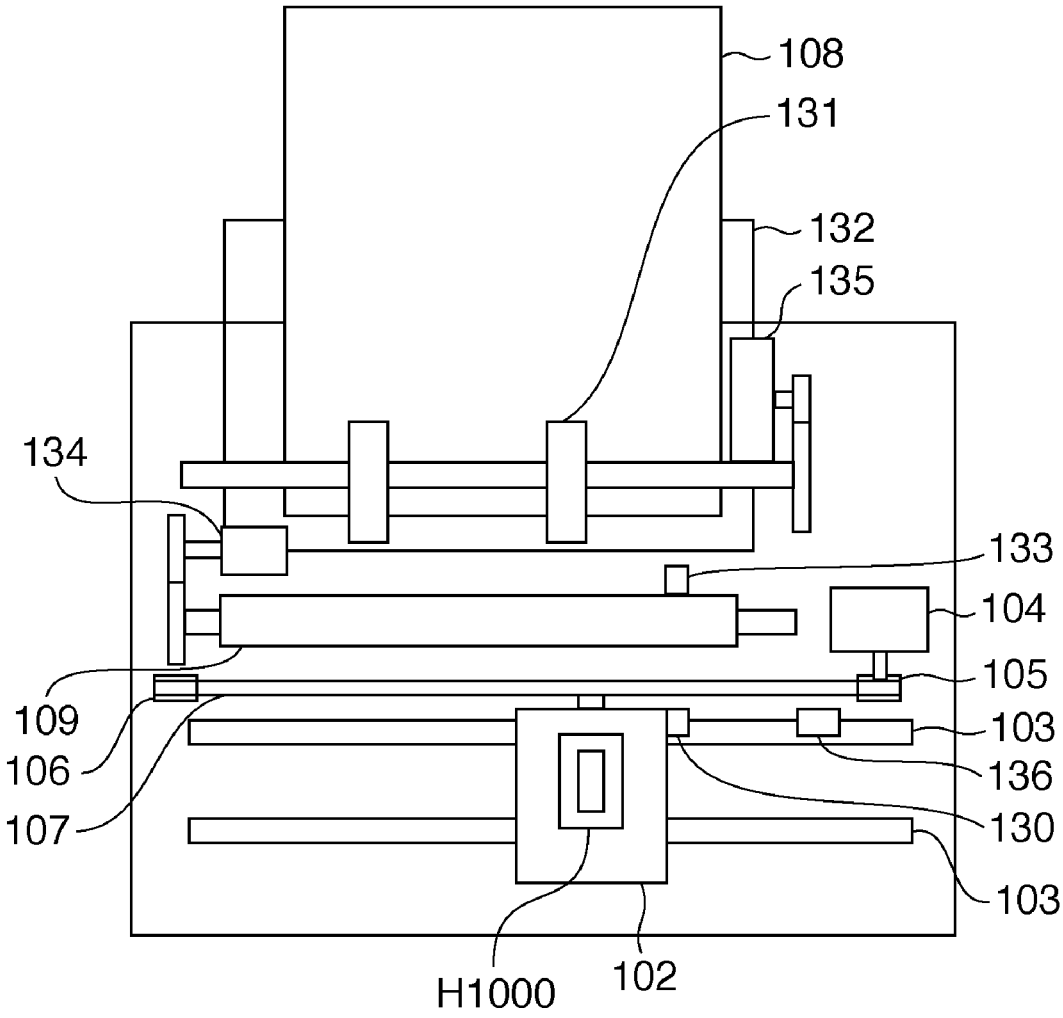
FIG. 12 is a schematic view showing an inkjet printing apparatus as a typical embodiment of the present invention.

A printing apparatus capable of mounting a printhead including an element substrate according to the present invention will be explained. FIG. 12 is a schematic view showing an example of an inkjet printing apparatus capable of mounting a printhead according to the present invention.

In the inkjet printing apparatus (to be also simply referred to as a printing apparatus hereinafter) shown in FIG. 12, a head cartridge H1000 is configured by combining a printhead including an element substrate according to the present invention, and a container which stores ink. The head cartridge H1000 is positioned and exchangeably mounted on a carriage 102. The carriage 102 includes an electrical connection for transmitting a driving signal and the like to each discharge portion via an external signal input terminal on the head cartridge H1000.

The carriage 102 is guided and supported reciprocally along guide shafts 103, which elongates in a main scanning direction, provided to the printing apparatus main body. A carriage motor 104 drives the carriage 102 via a driving mechanism including a motor pulley 105, associate pulley 106, and timing belt 107. Further, the carriage motor 104 controls the position and movement of the carriage 102. The carriage 102 includes a home position sensor 130. When the home position sensor 130 on the carriage 102 passes through the position of a shielding plate 136, it can detect the position.

An auto sheet feeder (ASF) 132 feeds printing media 108 such as a printing paper or a plastic thin film separately one by one as a feed motor 135 rotates a pickup roller 131 via a gear. As a conveyance roller 109 rotates, the printing medium 108 is conveyed (sub-scanned) via a position (printing portion) facing the orifice surface of the head cartridge H1000. The conveyance roller 109 rotates via a gear as a conveyance motor 134 rotates. When the printing medium 108 passes through a paper end sensor 133, the paper end sensor 133 determines whether the printing medium 108 has been fed, and finalizes the start position upon paper feed. The paper end sensor 133 is also used to detect the actual position of the trailing end of the printing medium 108 and finally detect the current print position from the actual position of the trailing end.

A platen (not shown) supports the lower surface of the printing medium 108 to form a flat printing surface at the printing portion. In this case, the head cartridge H1000 mounted on the carriage 102 is held so that the orifice surface extends downward from the carriage 102 and becomes parallel to the printing medium 108 between the pair of two conveyance rollers.

The carriage 102 supports the head cartridge H1000 so that the orifice arrangement direction of the printhead coincides with a direction perpendicular to the scanning direction of the carriage 102. The head cartridge H1000 discharges liquid from orifice arrays to print.

<Control Arrangement>

A control arrangement for executing printing control of the above-described inkjet printing apparatus will be explained.

Figure 13:
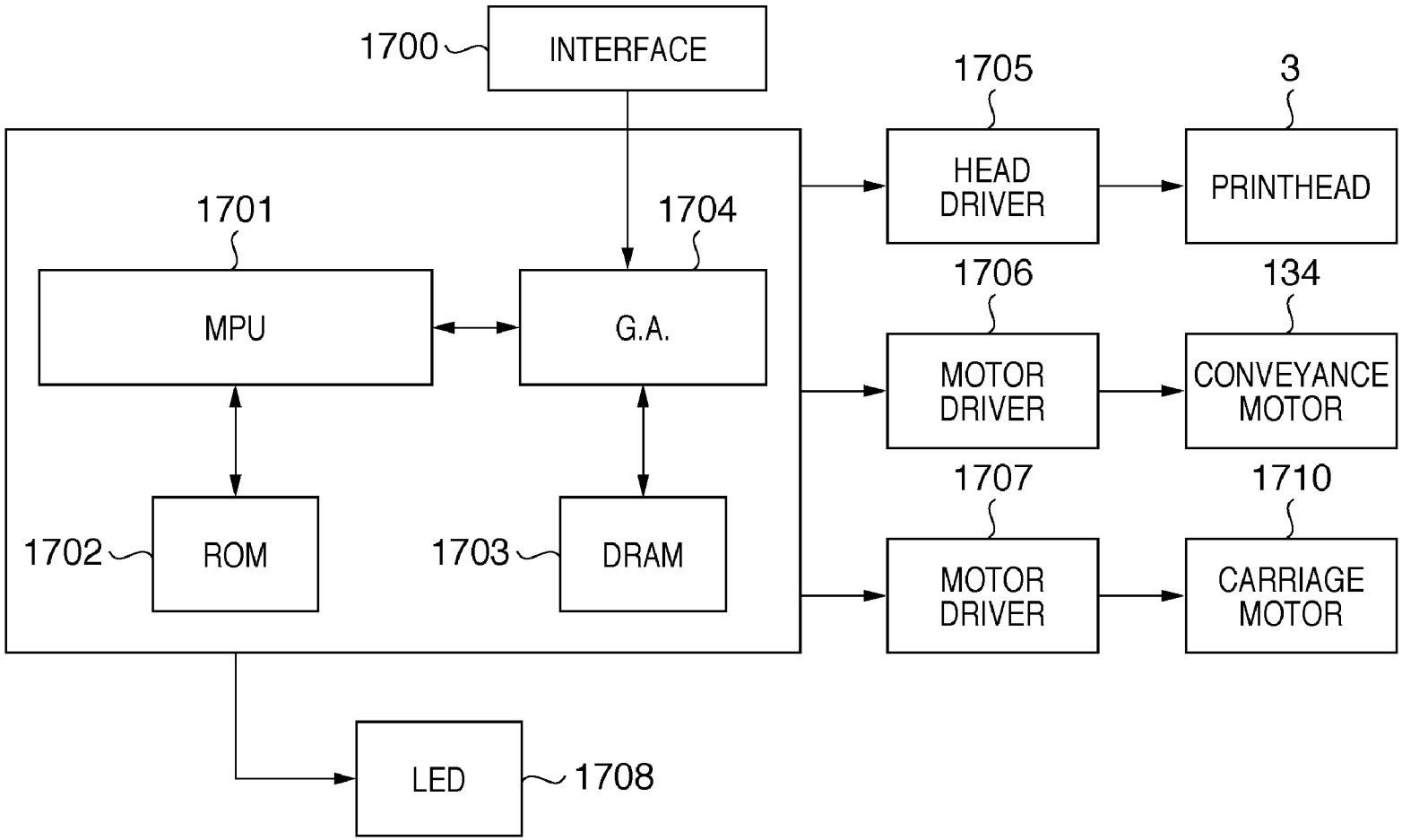
FIG. 13 is a block diagram showing the control arrangement of the inkjet printing apparatus shown in FIG. 12.

FIG. 13 is a block diagram showing the arrangement of the control circuit of the inkjet printing apparatus.

Referring to FIG. 13, an interface 1700 inputs a print signal. A ROM 1702 stores a control program to be executed by an MPU 1701. A DRAM 1703 saves various data (e.g., print data supplied to a printhead 3 of the head cartridge H1000). A gate array (G.A.) 1704 controls supply of print data to the printhead 3. The gate array 1704 also controls data transfer between the interface 1700, the MPU 1701, and the RAM 1703. A carriage motor 1710 conveys the head cartridge H1000 having the printhead 3. The conveyance motor 134 conveys a printing medium. A head driver 1705 drives the printhead 3, a motor driver 1706 drives the conveyance motor 134, and a motor driver 1707 drives the carriage motor 1710. For example, when the electrical connection is abnormal, an LED 1708 is turned on to notify this.

The operation of this control arrangement will be explained. When a print signal is input to the interface 1700, it is converted into print data between the gate array 1704 and the MPU 1701. Then, the motor drivers 1706 and 1707 are driven. At the same time, the printhead 3 is driven in accordance with the print data sent to the head driver 1705, thereby printing.

<Head Cartridge>

Figure 11:
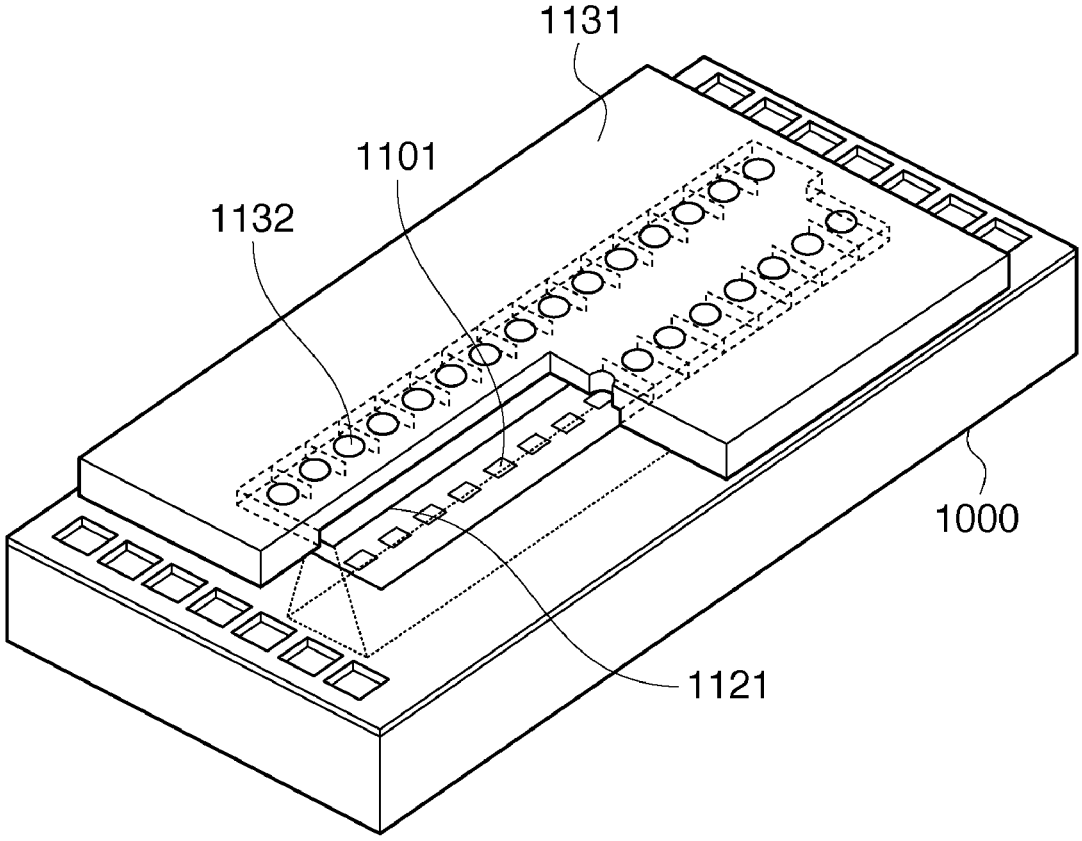
FIG. 11 is a perspective view showing an example of the element substrate.
Figure 14:
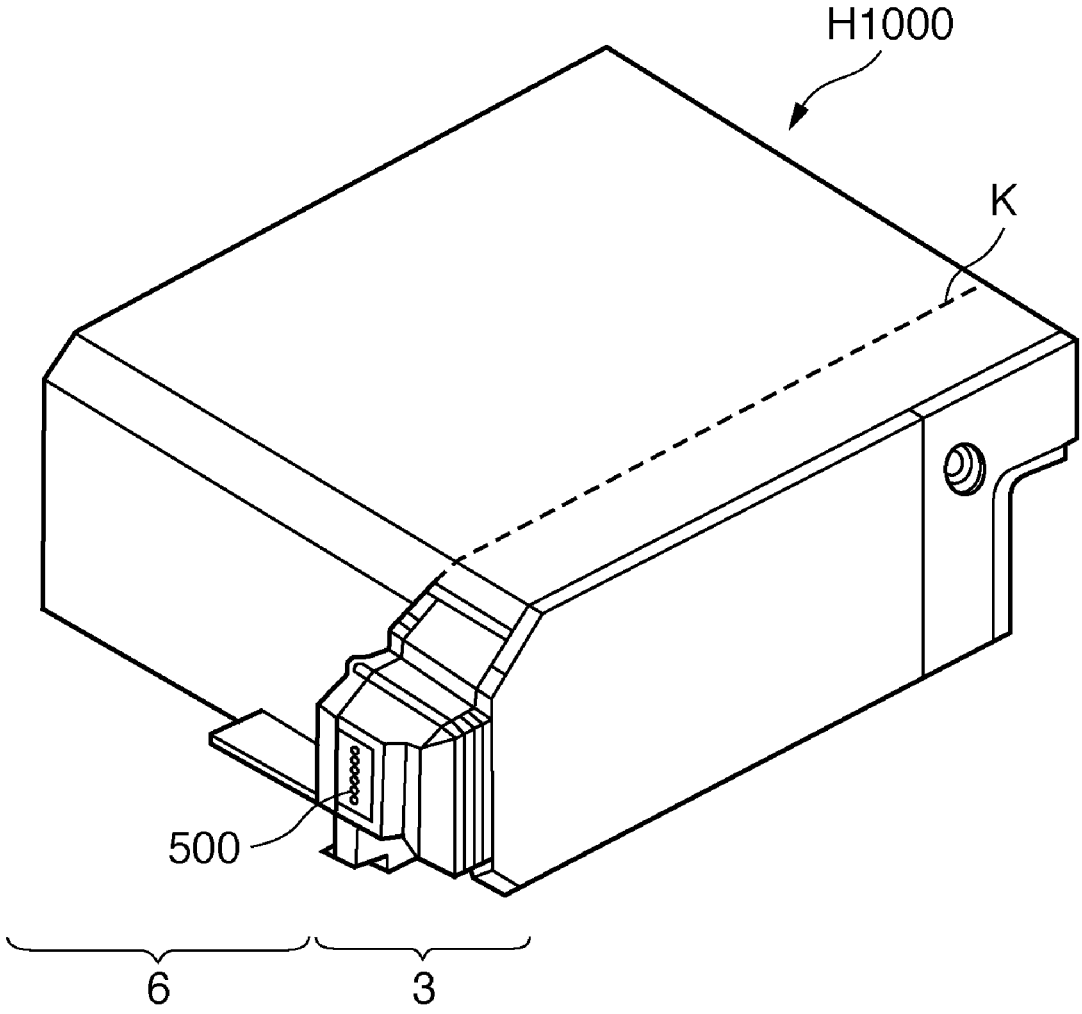
FIG. 14 is a perspective view showing the outer appearance of a head cartridge which integrates an ink tank and printhead.

FIG. 14 is a perspective view showing the outer appearance of the head cartridge H1000 which integrates an ink tank 6 and the printhead 3. Referring to FIG. 11, a dotted line K indicates the boundary between the ink tank 6 and the printhead 3. An ink orifice array 500 is an array of orifices. Ink stored in the ink tank 6 is supplied to the printhead 3 via an ink supply channel (not shown). The head cartridge H1000 has an electrode (not shown) for receiving an electrical signal supplied from the carriage 102 when the head cartridge H1000 is mounted on the carriage 102. The electrical signal drives the printhead 3 to selectively discharge ink from the orifices of the orifice array 500.

<Element Substrate>

Figure 6:
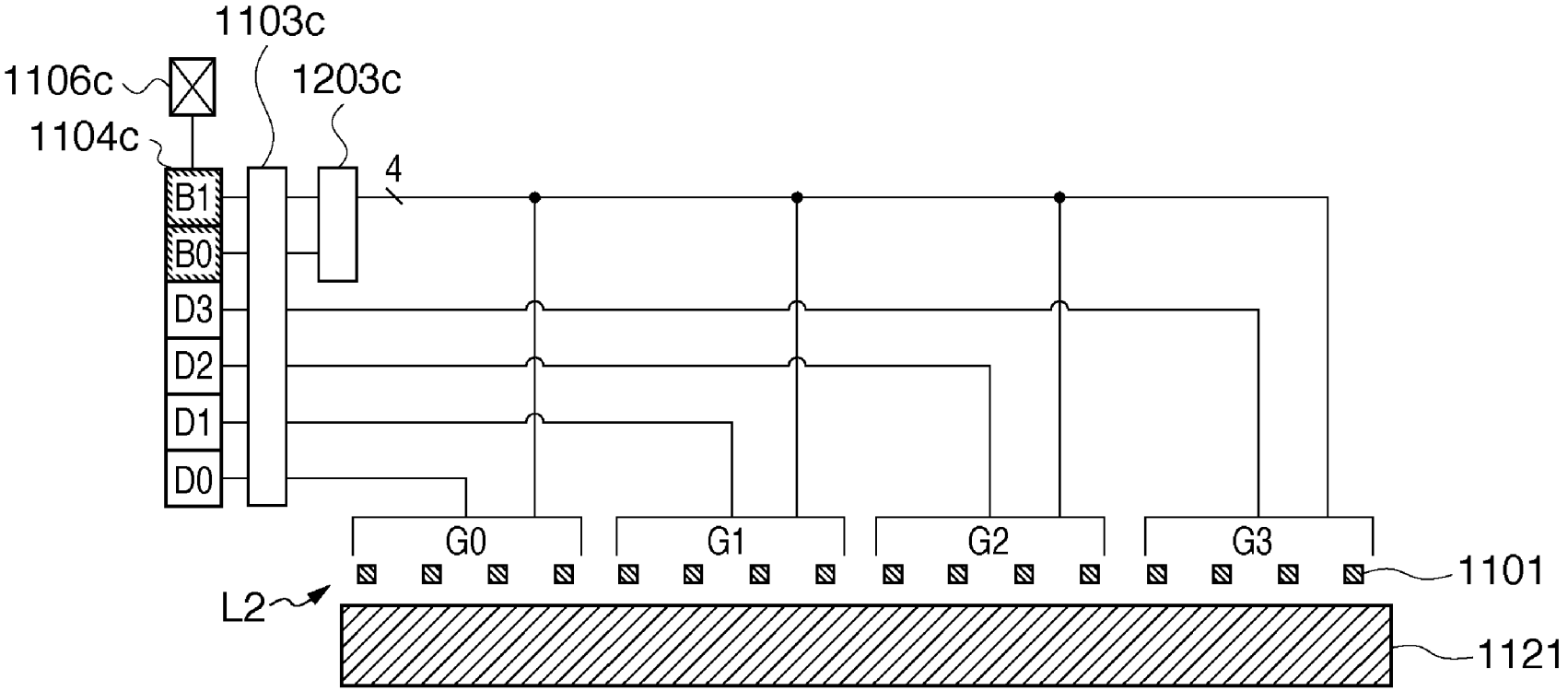
FIG. 6 is a block diagram of a heater array in which heaters are arrayed at low density, and a shift register corresponding to the heater array.
Figure 8:
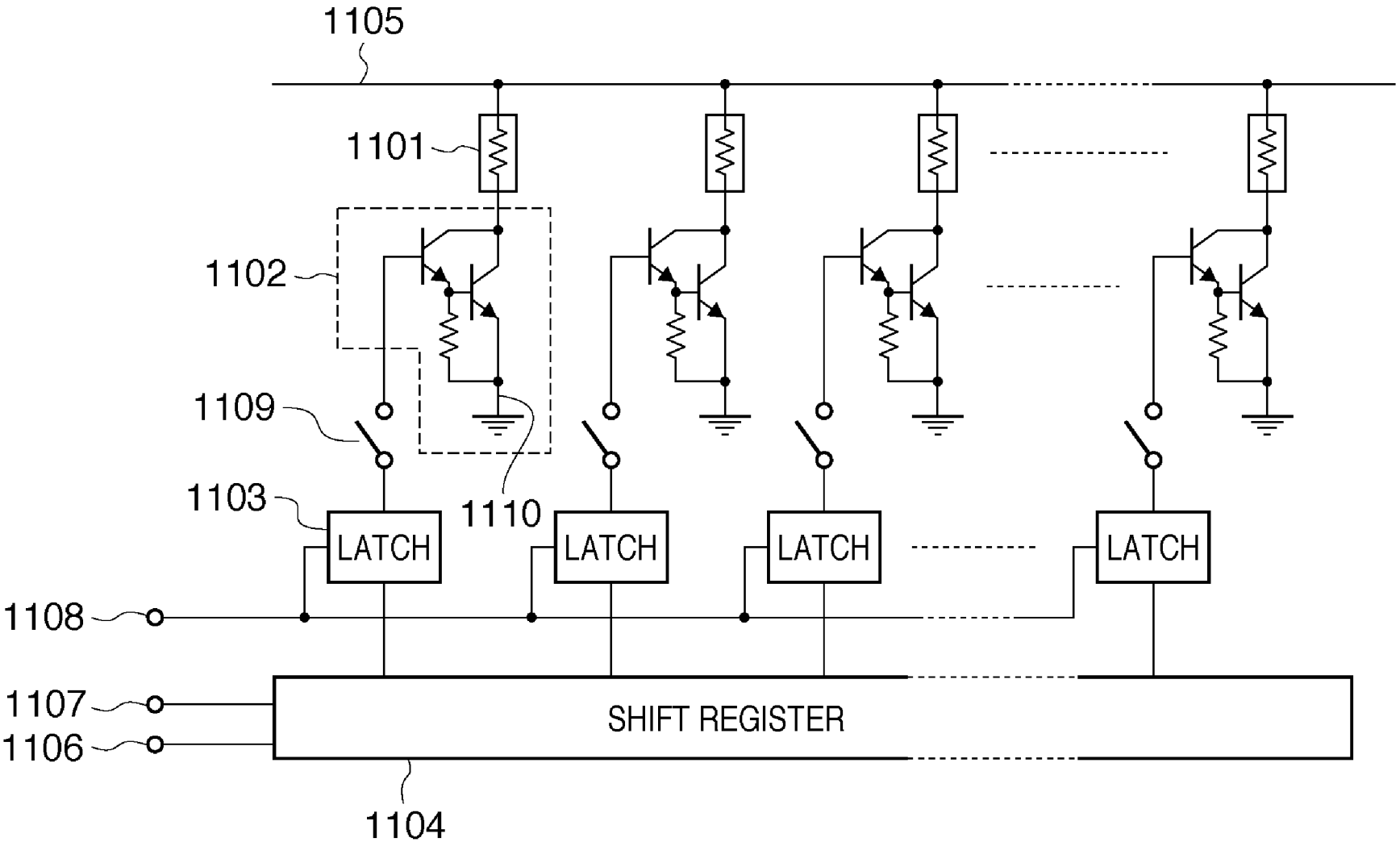
FIG. 8 is a diagram showing an example of the circuit arrangement of the element substrate.

An element substrate according to the present invention will be explained. FIG. 8 shows an example of the circuit arrangement of the element substrate. As shown in FIG. 6, heaters serving as print elements in the printhead, and their driving circuit are formed on a single substrate using a semiconductor process.

Referring to FIG. 8, each heater 1101 generates thermal energy, and each transistor (transistor unit) 1102 supplies a desired current to the heater 1101. A shift register 1104 temporarily stores print data which designates whether to supply a current to each heater 1101 and discharge ink from the orifice of the printhead. The shift register 1104 has a clock (CLK) input terminal 1107. A print data input terminal 1106 serially receives print data DATA for turning on/off the heater 1101. For each heater, a corresponding latch circuit 1103 latches print data of the heater. A latch signal input terminal 1108 inputs a latch signal LT which instructs the latch circuit 1103 of the timing of latch. Each switch 1109 determines the timing to supply a current to the heater 1101. A power supply line 1105 applies a predetermined voltage to the heater to supply a current. A ground line 1110 grounds the heater 1101 via the transistor 1102.

Figure 9:
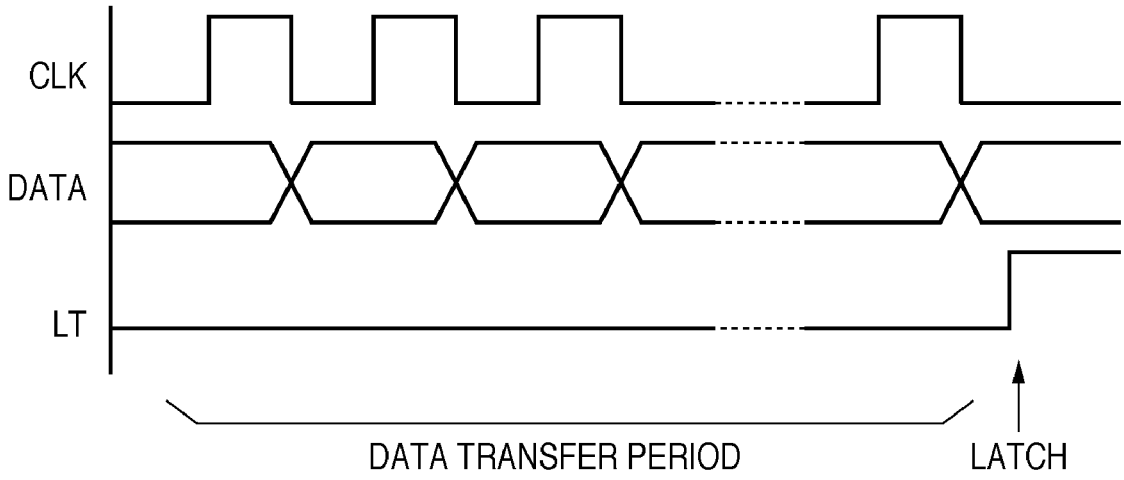
FIG. 9 is a timing chart of an example of various signals input to the element substrate.

FIG. 9 is a timing chart of various signals input to the element substrate shown in FIG. 8. Heater driving and the like on the element substrate shown in FIG. 8 will be explained with reference to FIG. 9.

The clock input terminal 1107 receives clocks CLK by the number of bits of print data stored in the shift register 1104. Data is transferred to the shift register 1104 in synchronism with the leading edge of the clock CLK. Print data DATA for turning on/off each heater 1101 is input from the print data input terminal 1106.

An element substrate in which the number of bits of print data stored in the shift register 1104 is equal to that of heaters and that of power transistors for driving heaters will be explained for descriptive convenience. Pulses of the clock CLK are input by the number of heaters 1101, and the print data DATA is transferred to the shift register 1104. Then, the latch signal LT is input from the latch signal input terminal 1108, and the latch circuit 1103 latches print data corresponding to each heater. The switch 1109 is turned on for an appropriate time. Then, a current flows through the transistor 1102 and heater 1101 via the power supply line 1105 in accordance with the ON time of the switch 1109. The current flows into the GND line 1110. At this time, the heater 1101 generates heat necessary to discharge ink, and the orifice of the printhead discharges ink in correspondence with print data.

Figure 10:
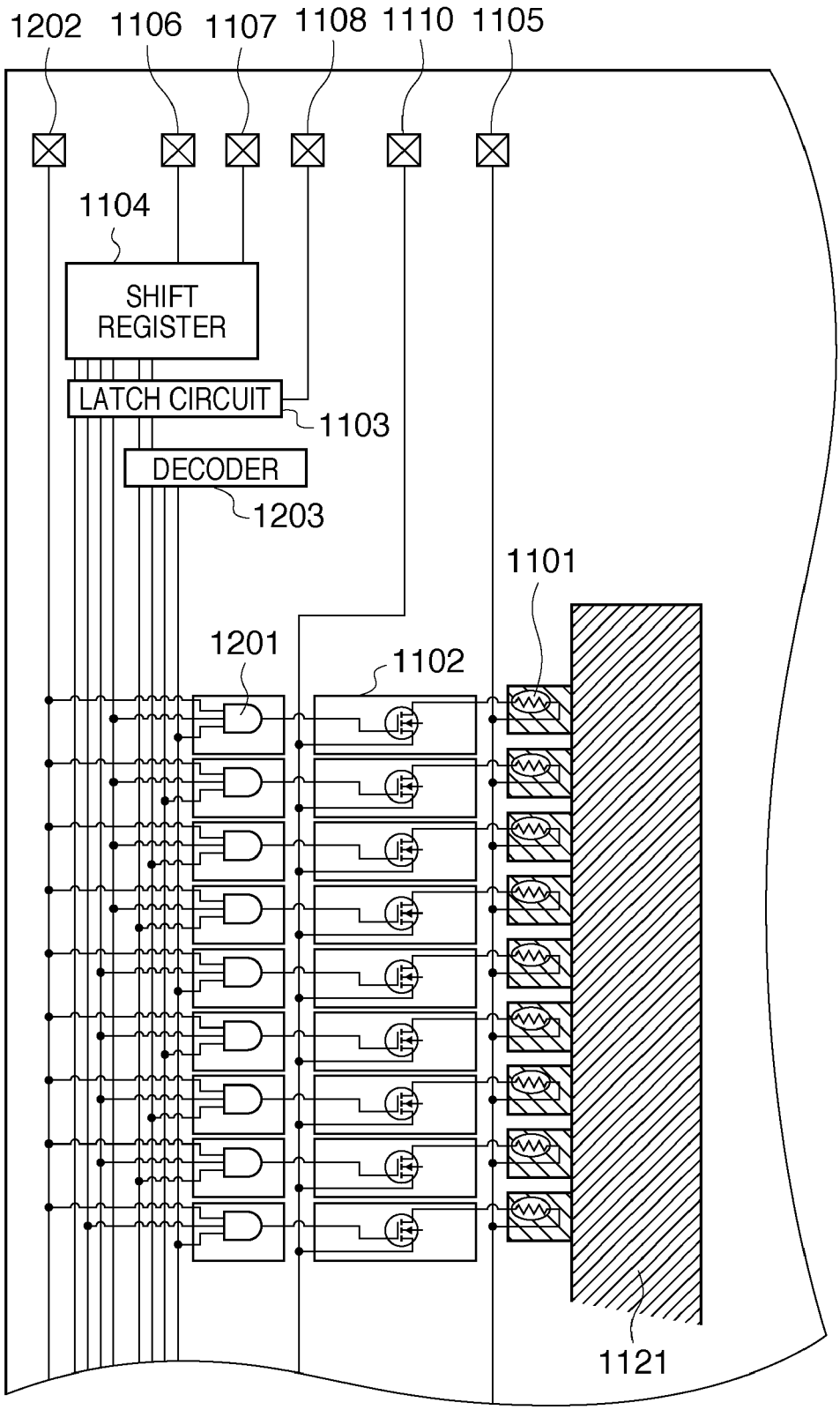
FIG. 10 is a block diagram of an example of a printhead element substrate which employs a time-divisional driving method.

A time-divisional driving method for an element substrate which drives heaters using a shift register in which the number of bits is smaller than that of heaters will be explained with reference to FIG. 10. According to the time-divisional driving method, heaters are divided into a plurality of blocks, and the heaters are driven by changing the time for each block, instead of concurrently driving all the heaters of a single heater array. The time-divisional driving method can decrease the number of concurrently driven heaters.

For example, when dividing all the heaters of a single heater array into N ($N=2^n$: n is a positive integer) blocks and driving them time-divisionally (in N time division), every N adjacent heaters in a single heater array belong to one group. Assume that the heater array includes m groups (the total number of heaters of this heater array is N×m). Data input to the shift register 1104 are block control data for selecting a block, and print data for the block. In FIG. 10, N=4, and every four heaters are driven concurrently.

A decoder 1203 receives block control data, and each AND circuit 1201 receives a block selection signal which is generated by the decoder 1203 on the basis of the block control data. The AND circuit 1201 builds the driving circuit of the heater 1101. The AND circuit 1201 is arranged in correspondence with each heater 1101. The number of bits of block control data necessary for N-time-divisional driving is n. Hence, m-bit print data and n-bit block control data are input from the print data input terminal 1106. Thus, the number of bits in the shift register 1104 and latch circuit 1103 is (n+m) bits. In this element substrate, to drive all the heaters of a hater array once, the gate array 1704 inputs, N times, (n+m)-bit data formed from print data and block control data. A heater driving signal in one-to-one correspondence with a heater is generated based on a print data signal based on the print data, a block selection signal based on the block control data, and a heat enable signal input from a heat enable signal input terminal 1202. The generated heater driving signal drives a corresponding heater.

<Method of Manufacturing Element Substrate and Printhead>

A method of manufacturing an element substrate according to the present invention and a printhead including the element substrate will be explained for a part associated with the present invention.

FIG. 11 is a perspective view showing an example of the element substrate according to the present invention. On the surface of an element substrate 1000, the heaters 1101 and their driving circuits are formed by a semiconductor process using an Si wafer with 0.5 to 1 mm thickness. Each orifice 1132 for discharging ink is formed by photolithography using an orifice forming member 1131 made of a resin material, together with an ink channel wall for forming an ink channel corresponding to each heater 1101 of the element substrate 1000.

To supply ink to each orifice 1132, an ink supply port 1121, which is a long groove-like through hole with a surface inclined from the lower surface to upper surface of the element substrate, is formed by anisotropic etching using the crystal orientation of the Si wafer.

The element substrate having this structure can build a head cartridge by connecting the ink supply port 1121 and a channel member for guiding ink to the ink supply port 1121, and combining them with a container which stores ink. Particularly when the head cartridge is configured by combining containers which store inks of a plurality of colors, and element substrates for the respective colors, color printing can be performed using this head cartridge.

<Driving Circuit in Element Substrate>

Several embodiments of a heater array and shift register in the element substrate according to the present invention will be explained below in detail.

Element substrates in the following embodiments are those for an inkjet printhead. In these element substrates, a plurality of heater arrays each including a plurality of heaters are arranged along the ink supply port 1121. More specifically, each element substrate includes a heater array (first print element array) made up of a relatively large number of heaters serving as print elements, and a heater array (second print element array) made up of a relatively small number of heaters as printing elements. In the following embodiments, both the number of heaters (number of print elements) and the heater arrayed density differ between heater arrays to clarify features of the present invention. However, the present invention is also applicable to a case where the heater arrayed density is equal and only the number of heaters differs between heater arrays.

First Embodiment

Figure 1:
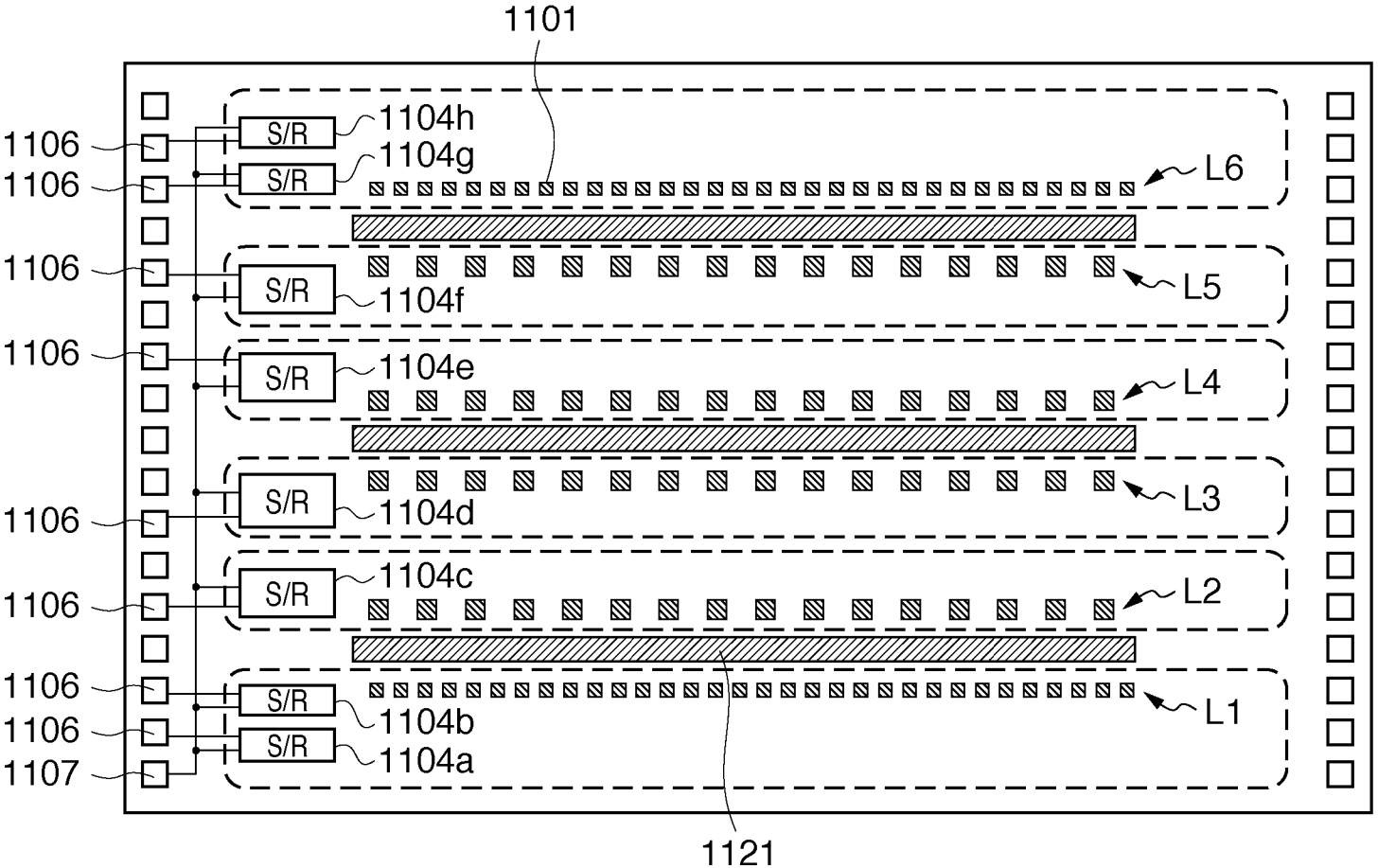
FIG. 1 is a schematic view of an element substrate according to the first embodiment of the present invention.
Figure 2:
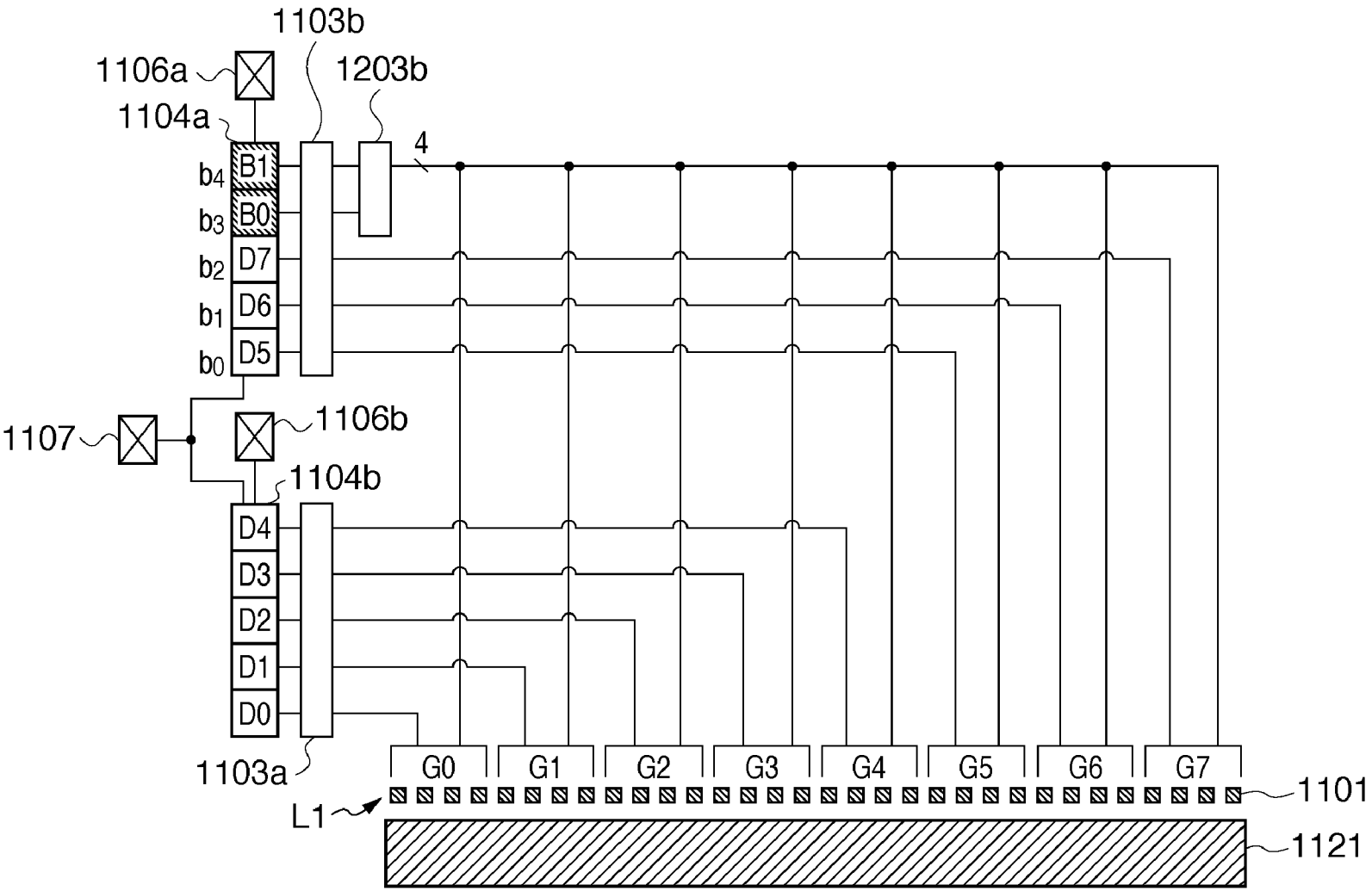
FIG. 2 is a block diagram of a heater array in which heaters are arrayed at high density in the element substrate shown in FIG. 1, and a shift register corresponding to the heater array.

FIG. 1 is a schematic view showing an element substrate according to the first embodiment. FIG. 1 shows the arrangement of heater arrays and shift registers in the element substrate. The element substrate includes six (6) heater arrays L1 to L6. In the heater arrays L1 and L6, heaters are arrayed at high density in the arrayed direction. In the heater arrays L2, L3, L4, and L5, heaters are arrayed at low density in the arrayed direction. For example, shift registers 1104*a* and 1104*b* correspond to the heater array L1. A shift register 1104*c* corresponds to the heater array L2. The remaining heater arrays and the remaining shift registers also have the same correspondence as that shown in FIG. 1. FIG. 2 is a block diagram of the heater array L1 in which heaters 1101 are arrayed at high density in the element substrate shown in FIG. 1, and the shift registers 1104*a* and 1104*b* corresponding to the heater array L1. FIG. 6 is a block diagram of the heater array L2 in which the heaters 1101 are arrayed at low density in the element substrate shown in FIG. 1, and the shift register 1104*c* corresponding to the heater array L2.

Figure 5:
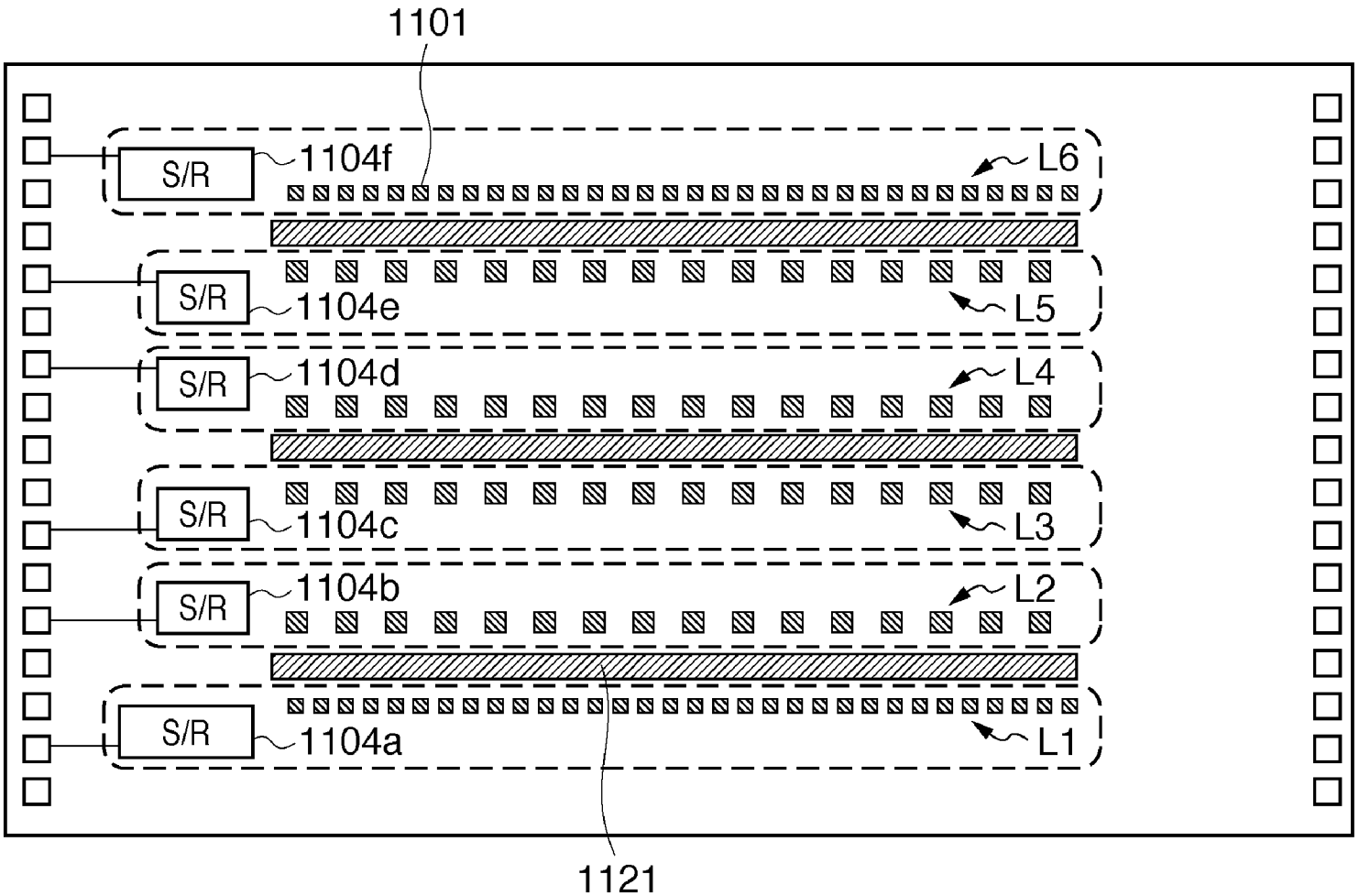
FIG. 5 is a schematic view of an element substrate for comparison with the element substrate of the first embodiment.
Figure 7:
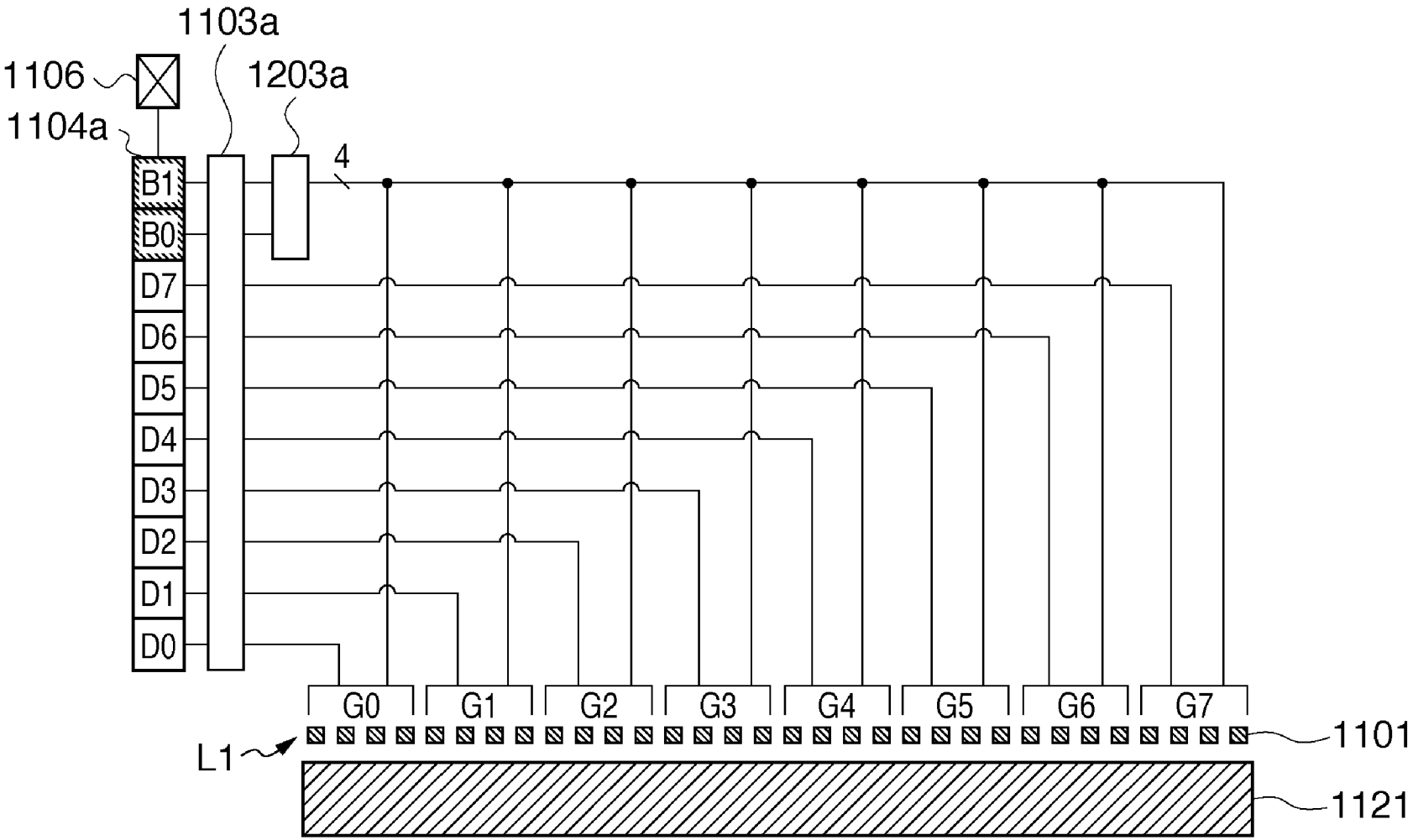
FIG. 7 is a block diagram of a heater array in which heaters are arrayed at high density in the element substrate shown in FIG. 5, and a shift register corresponding to the heater array.

FIG. 5 is a schematic view showing an element substrate for comparison with the element substrate of the first embodiment. FIG. 5 shows the arrangement of heater arrays and shift registers S/R in the element substrate. Similar to FIG. 1, the element substrate in FIG. 5 includes six (6) heater arrays L1 to L6. However, for all heater arrays in FIG. 5, one shift register corresponds to one heater array. For example, the shift register 1104*a* corresponds to the heater array L1, and a shift register 1104*f* corresponds to the heater array L6. FIG. 7 is a block diagram of a heater array in which heaters are arrayed at high density in the element substrate of FIG. 5, and a shift register corresponding to the heater array. Note that FIG. 6 is commonly used as the block diagram of a heater array in which heaters are arrayed at low density in the element substrate of FIG. 5, and a shift register corresponding to the heater array.

The element substrates shown in FIGS. 1 and 5 employ a multi-layer wiring technique. Insulating layers sandwich an interconnection (interconnection made of aluminum, copper, gold, or an alloy containing aluminum, copper, or gold) which connects building elements. A plurality of interconnection layers are formed on the element substrate. Each interconnection layer is connected to its upper and lower interconnection layers via through-holes (openings of the insulating layers) at any desired portions in the element substrate. In the element substrates of FIGS. 1 and 5, juxtaposed heater arrays are equal in length.

In the element substrates shown in FIGS. 1 and 5, each ink supply port 1121 supplies ink from the lower surface of the element substrate to orifices. A plurality of heaters 1101 are arranged at high density along the ink supply port 1121.

Each heater array in the element substrates of FIGS. 1 and 5 includes m groups each made up of N ($2^n$) adjacent heaters. In each heater array, as many power supply lines and GND lines as groups run from the heater array to the terminals of the power supply lines and GND lines. Heaters in each group are parallel-connected by one power supply line and one GND line. Heaters in each group are driven not concurrently but sequentially by time-divisional driving. Thus, the maximum number of heaters driven per unit time equals the numbers of power supply line and GND lines.

The element substrate according to the first embodiment shown in FIG. 1 has a plurality of heater arrays including a heater array in which a relatively large number of heaters are arranged at high density, and a heater array in which a relatively small number of heaters are arranged at low density. To clarify features of the present invention, the element substrate according to the first embodiment will be explained to have a simple form. For example, the number of heaters of a heater array such as the heater array L2 or L3 in which heaters are arranged at low density (600 dpi) is 16. The number of heaters of a heater array such as the heater array L1 or L6 in which heaters are arranged at high density (1,200 dpi) is 32. Time-divisional driving uses a common clock CLK and latch signal within the element substrate.

In the element substrate of the first embodiment, a heater array in which heaters are arranged at low density includes four groups G0, G1, G2, and G3 each made up of four adjacent heaters, as shown in FIG. 6. Also, this heater array includes four blocks each made up of a total of four heaters which are selected one by one from the respective groups and are driven concurrently. As shown in FIG. 2, a heater array in which heaters are arranged at high density includes eight groups G0, G1, G2, G3, G4, G5, G6, and G7 each made up of four adjacent heaters. This heater array includes four blocks each made up of a total of eight heaters which are selected one by one from the respective groups and are driven concurrently. In other words, one block includes eight nozzles.

Two shift registers are arranged in correspondence with the heater array in which heaters are arranged at high density. One shift register is arranged in correspondence with the heater array in which heaters are arranged at low density. The printhead includes signal lines each having a terminal 1106 for inputting data. The printhead uses a common clock signal line 1107. The shift register is configured by successively arraying circuit elements with the same arrangement by the number of data bits to be stored. A circuit which corresponds to one data signal and is configured by successively arraying circuit elements with the same arrangement will be defined as a shift register circuit.

Next, a latch circuit 1103*c* shown in FIG. 6 will be explained. The latch circuit 1103*c* uses a 6-bit parallel bus to latch data held in the shift register 1104*c*. The latch circuit 1103*c* outputs data D0 to the group G0, data D1 to the group G1, data D2 to the group G2, and data D3 to the group G3. A decoder 1203*c* receives block control data B0 and B1 of 2 bits latched by the latch circuit 1103*c*, generates control data of 4 bits, and outputs them to the respective groups. In accordance with the control data, a heater to be driven is selected from each group.

In the element substrate, a driving circuit (not shown) for each heater array receives a print data signal based on print data and a block selection signal based on block control data. The shift register corresponding to the heater array in which heaters are arranged at low density holds 6 bits, as shown in FIG. 6. More specifically, the shift register holds print data D0 to D3 of 4 bits for four groups, and block control data B0 and B1 of 2 bits for selecting a block to be driven from the four blocks.

Each of the shift registers 1104*a* and 1104*b* corresponding to the heater array in which heaters are arranged at high density holds 5 bits, as shown in FIG. 2. In the shift register 1104*a*, bit 0 ($b_0$) to bit 2 ($b_2$) in the first area are print data used in the heater array L1. Bit 3 ($b_3$) and bit 4 ($b_4$) in the second area are assigned to block driving control data of the heater array L1. The respective shift registers include independent data signal terminals 1106*a* and 1106*b* in order to input these data. The clock signal CLK is input from the common signal terminal 1107. A total of 10-bit data including the print data D0 to D7 of 8 bits for the eight groups, and the block control data B0 and B1 of 2 bits for selecting a block to be driven from the four blocks are divided for the two shift registers and held. More specifically, one shift register holds the print data D0 to D4 of 5 bits. The other shift register holds the print data D5 to D7 of 3 bits and the block control data B0 and B1 of 2 bits.

A decoder 1203*b* receives the block control data B0 and B1, generates control data of 4 bits, and outputs them to the respective groups. In accordance with the control data, one heater is selected from the four heaters of each group.

That is, two shift register circuits are arranged for a high-density heater array, and include independent data signal lines.

Figure 15A:
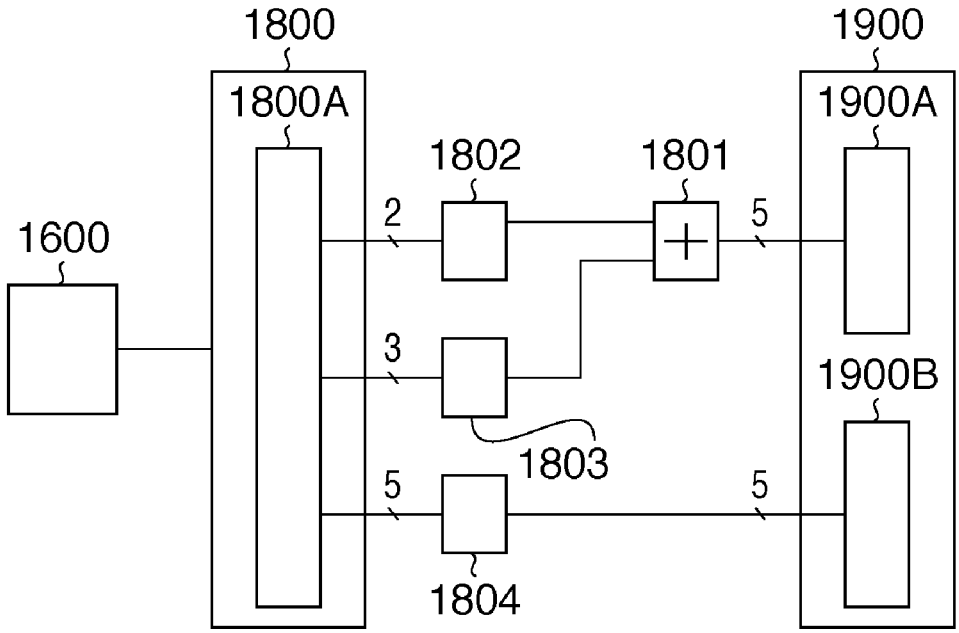
FIGS. 15A and 15B are circuit diagrams for explaining in detail the control arrangement of the inkjet printing apparatus.

FIG. 15A is a circuit diagram of the control circuit of an inkjet printing apparatus according to the first embodiment. Processing for print data and block control data will be explained with reference to FIG. 15A. A data generation unit 1800 receives print data buffered in a print buffer 1600, and generates data to be transferred to the printhead. A transfer unit 1900 transfers, to the printhead, data generated by the data generation unit 1800. A gate array 1704 includes the data generation unit 1800 and transfer unit 1900. A DRAM 1703 includes the print buffer.

The data generation unit 1800 generates print data D0 to D7 of 8 bits used in the heater array. Although not described in detail, the data generation unit 1800 generates column binary data when data buffered in the print buffer are raster multilevel data. The data generation unit 1800 buffers the generated data (print data D0 to D7 and block control data B0 and B1) in a buffer 1800A. A latch circuit 1802 latches the block control data B0 and B1 among the buffered data.

Latch circuits 1803 and 1804 latch the print data D0 to D7. More specifically, the latch circuit 1803 latches the print data D5 to D7, and the latch circuit 1804 latches the print data D0 to D4. A data coupling unit 1801 couples outputs from the latch circuits 1802 and 1803. The data coupling unit 1801 holds a total of 5 bits: the print data D5 to D7 and block control data B0 and B1.

The transfer unit 1900 includes a transfer buffer 1900A which buffers data to be transferred to the shift register 1104*a*, and a transfer buffer 1900B which buffers data to be transferred to the shift register 1104*b*. Each of the transfer buffers 1900A and 1900B transfers 5-bit data. This arrangement generates data to be transferred to the printhead.

This arrangement contributes to reducing the difference between the number of data bits held in one shift register circuit corresponding to a heater array in which heaters are arranged at low density, and the number of data bits held in each of two shift register circuits corresponding to a heater array in which heaters are arranged at high density. It is also possible to make, equal to each other, the number of data bits held in two shift register circuits corresponding to a heater array in which heaters are arranged at high density, and the number of data bits held in one shift register circuit corresponding to a heater array in which heaters are arranged at low density.

The data transfer speed difference becomes smaller as the numbers of data bits held in all shift register circuits come closer to each other. This prevents an excessively low data transfer speed to a heater array in which heaters are arranged at high density, compared to a data transfer speed to a heater array in which heaters are arranged at low density. In the first embodiment, one of two shift register circuits corresponding to the heater array in which heaters are arranged at high density holds block control data. The other shift register circuit holds not block control data but only print data.

The element substrate in FIG. 5 for comparison with the element substrate of the first embodiment has the same heater array arrangement as that of the element substrate in FIG. 1. The arrangement of the element substrate in FIG. 5 is different from that of the element substrate in FIG. 1 in the following point. The element substrate in FIG. 5 adopts one shift register in correspondence with a heater array in which heaters are arranged at high density. For this reason, as shown in FIG. 7, one shift register holds a total of 10-bit data including the print data D0 to D7 of 8 bits for the eight groups, and the block control data B0 and B1 of 2 bits for selecting a block to be driven from the four blocks. The difference between the number of bits (10 bits) of the shift register corresponding to the heater array in which heaters are arranged at high density, and that of bits (6 bits) of the shift register corresponding to the heater array in which heaters are arranged at low density is 4 bits. The data transfer speed to the heater array in which heaters are arranged at high density decreases to 6/10, and is much lower than that to the heater array in which heaters are arranged at low density. This reveals that the data transfer speed of the element substrate according to the first embodiment shown in FIG. 1 is higher than that of the element substrate in FIG. 5.

Second Embodiment

Figure 3:
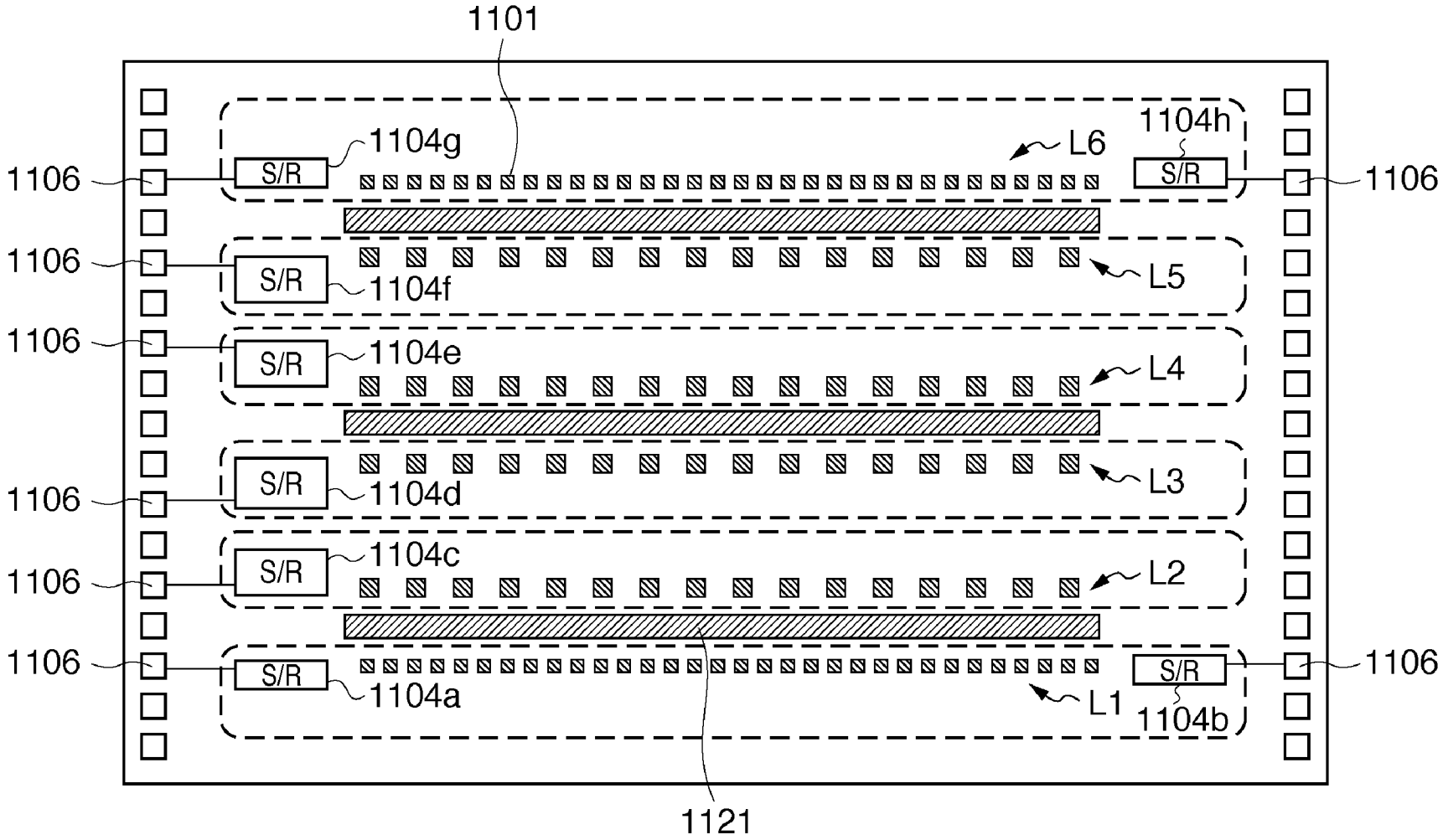
FIG. 3 is a schematic view of an element substrate according to the second embodiment of the present invention.
Figure 4:
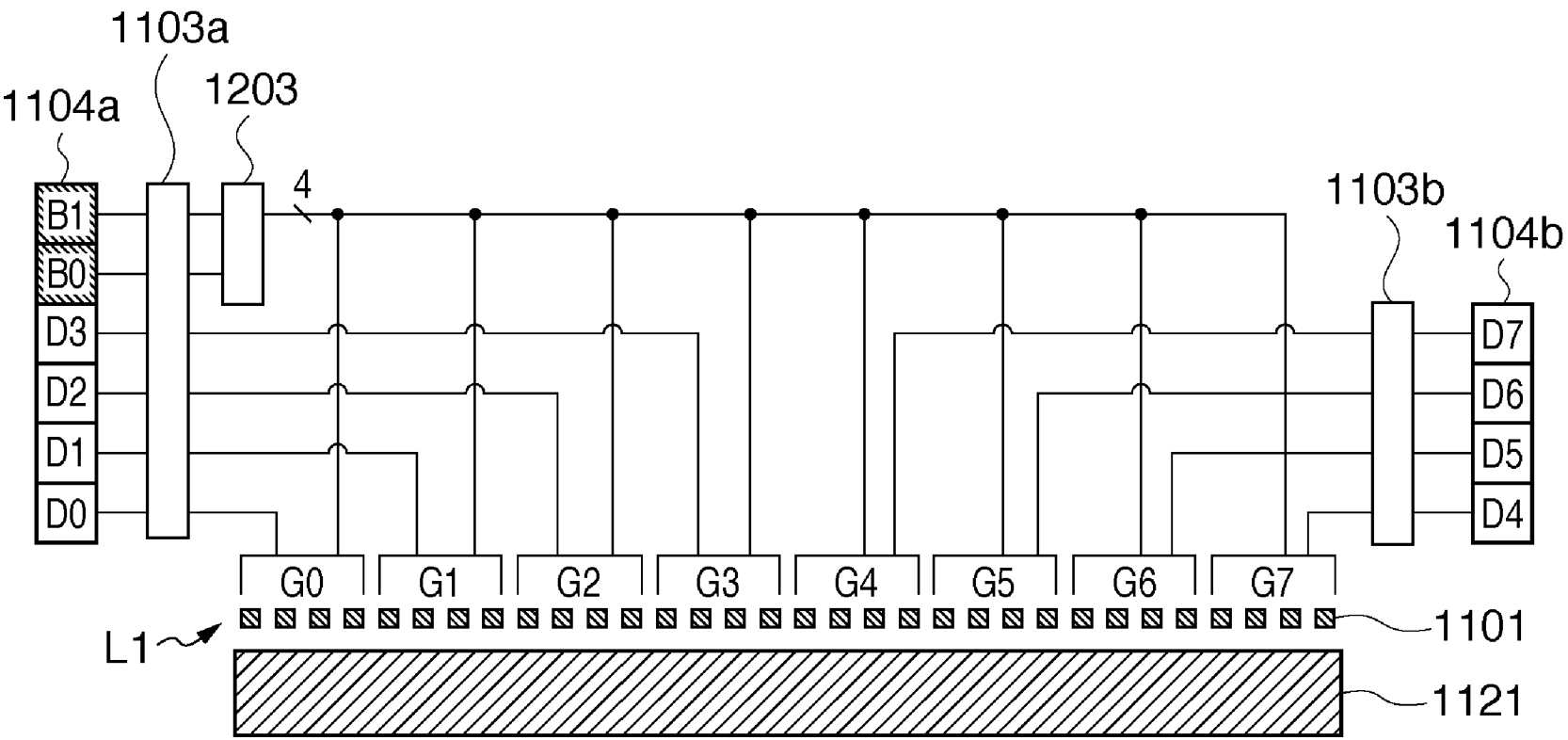
FIG. 4 is a block diagram of a heater array in which heaters are arrayed at high density in the element substrate shown in FIG. 3, and a shift register corresponding to the heater array.

FIG. 3 is a schematic view showing an element substrate according to the second embodiment. FIG. 3 shows the arrangement of heater arrays and shift registers in the element substrate. FIG. 4 is a block diagram of a heater array in which heaters are arrayed at high density in the element substrate of FIG. 3, and shift registers corresponding to the heater array. Note that FIG. 6 is commonly used as the block diagram of a heater array in which heaters are arrayed at low density, and a shift register corresponding to the heater array. The difference between the element substrate of the second embodiment and that of the first embodiment shown in FIG. 1 will be explained.

In the element substrate of the second embodiment, as for a heater array in which heaters are arrayed at high density, the arrangement positions of terminals for inputting print data and block control data, and those of shift registers with respect to the heater array in the element substrate are different from those in the element substrate of the first embodiment. In the element substrate of the first embodiment, terminals for inputting print data and block control data, and shift registers are arranged at one end of the element substrate in the longitudinal direction (print element-arrayed direction of the print element array). To the contrary, in the element substrate of the second embodiment, terminals for inputting print data and block control data, and shift registers are arranged at the two ends of the print element array. For example, shift registers 1104*a* and 1104*b* are arranged at the two ends of a heater array L1. Each shift register has an independent data input line, similar to the first embodiment.

In the element substrate of the second embodiment, two shift registers corresponding to a heater array in which heaters are arrayed at high density are not 5-bit shift registers. One shift register is a 4-bit shift register which holds 4 bits out of 8-bit print data. The other shift register is a 6-bit shift register which holds 4-bit print data and 2-bit block control data.

Figure 15B:
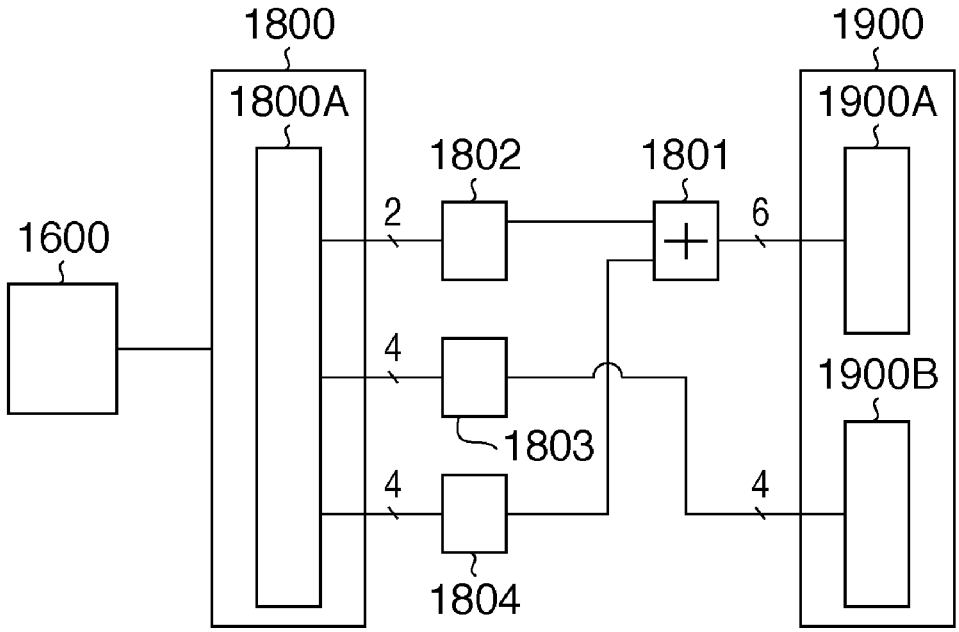

FIG. 15B is a circuit diagram of the control circuit of an inkjet printing apparatus according to the second embodiment. Only a difference from the first embodiment will be explained, and a description of the same contents will not be repeated. The second embodiment is different from the first embodiment in print data to be coupled with block control data by a data coupling unit 1801. In addition, a transfer buffer 1900A buffers 6-bit data, whereas a transfer buffer 1900B buffers 4-bit data.

The element substrate in the second embodiment prevents a decrease in data transfer speed to a heater array in which heaters are arranged at high density. Further, the element substrate is downsized by increasing the layout efficiency of the element substrate. In an element substrate employing the time-divisional driving method, as many print data signal lines as groups run from a shift register to a heater array. Thus, the element substrate in the second embodiment requires a wiring area for laying out eight print data signal lines for a heater array in which heaters are arranged at high density. In the element substrate of the second embodiment, eight print data signal lines are divided into two each for four adjacent groups. The two sets each of four lines are respectively connected to shift registers arranged at the two ends of the element substrate in the longitudinal direction. In this manner, a wiring area required for eight print data signal lines substantially fall within that required for four lines. One shift register further holds 2-bit block control data. As a result, the wiring area of print data signal lines which connect a heater array and a shift register decreases. This contributes to decreasing the interval between ink supply ports 1121. Particularly, this results in decreasing the area of an element substrate having many ink supply ports.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-122773, filed May 8, 2008, which is hereby incorporated by reference herein in its entirety.

What is claimed is:

1. A print element substrate comprising:

a first print element array having a plurality of print elements;

a second print element array having a plurality of print elements;

a first driving circuit which divides the plurality of print elements included in said first print element array into a predetermined number of groups and time-divisionally drives print elements belonging to each group;

a second driving circuit which divides the plurality of print elements included in said second print element array into a number of groups larger than the predetermined number of groups, and time-divisionally drives print elements belonging to each group;

a first shift register circuit which holds data for driving the print elements belonging to said first print element array;

a second shift register circuit and a third shift register circuit which divide a plurality of groups forming said second print element array into at least a first group set and a second group set, and hold data for driving the print elements belonging to each group set; and three signal lines which respectively transfer externally input signals to said first shift register circuit, said second shift register circuit, and said third shift register circuit.

2. The print element substrate according to claim 1, wherein the data held in said second shift register circuit includes information for selecting a print element to be driven from the print elements belonging to the groups forming said second print element array.

3. The print element substrate according to claim 2, wherein a plurality of shift register circuits for said second print element array are arranged at two ends of said second print element array.

4. The print element substrate according to claim 1, wherein a count of time division for a time-divisional drive performed by said first driving circuit is equal to a count of time division for a time-divisional drive performed by said second driving circuit.

5. An inkjet printhead, having a print element substrate according to claim 1, for printing by discharging ink.

6. A printing apparatus comprising a carriage to which an inkjet printhead according to claim 5 can be attached.

7. The apparatus according to claim 6, further comprising a circuit for generating data to be held by the first and second shift register circuits.

* * * * *